United States Patent [19]

Marty

[11] Patent Number: 5,073,991

[45] Date of Patent: Dec. 24, 1991

[54] PULL-OUT LAVATORY

[75] Inventor: Garry R. Marty, Fishers, Ind.

[73] Assignee: 501 Masco Industries, Inc., Taylor, Mich.

[21] Appl. No.: 642,117

[22] Filed: Jan. 16, 1991

[51] Int. Cl.[5] ..... E03C 1/04; F16K 27/00

[52] U.S. Cl. ..... 4/192; 137/801

[58] Field of Search ..... 4/192, 615, 567, 568, 4/570; 285/360, 361, 376, 396, 401, 402; 137/801, 359, 375

[56] References Cited

U.S. PATENT DOCUMENTS

| | | | |
|---|---|---|---|
| 242,564 | 6/1881 | Sholder | 285/360 X |
| 255,523 | 3/1882 | Lightburne, Jr. | 285/360 X |
| 1,788,282 | 1/1931 | Drager | 285/361 X |
| 1,841,737 | 1/1932 | Judell | 4/192 |
| 2,367,809 | 1/1945 | Stein et al. | 137/801 |
| 2,585,997 | 2/1952 | Bruewer | 137/801 |
| 2,781,786 | 2/1957 | Young | 137/801 |
| 3,185,503 | 5/1965 | Angle | 285/361 X |
| 3,571,821 | 3/1971 | Kaiser | 4/192 |
| 3,590,876 | 7/1971 | Young | 137/801 |
| 3,871,406 | 3/1975 | Anderson | 137/801 |
| 4,356,574 | 11/1982 | Johnson | 4/192 |
| 4,387,738 | 6/1983 | Bisonaya et al. | 4/194 X |
| 4,449,737 | 5/1984 | Specht | 285/360 X |
| 4,484,600 | 11/1984 | Peterson et al. | 4/192 X |
| 4,548,224 | 10/1985 | McLaughlin | 4/192 X |
| 4,889,165 | 12/1989 | Necombe et al. | 4/192 X |

FOREIGN PATENT DOCUMENTS

| | | | |
|---|---|---|---|
| 3522390 | 1/1987 | Fed. Rep. of Germany | 4/192 |
| 3726788 | 2/1989 | Fed. Rep. of Germany | 4/615 |
| 0029628 | 3/1958 | Finland | 4/192 |
| 0512257 | 1/1955 | Italy | 137/801 |

*Primary Examiner*—William A. Cuchlinski, Jr.
*Assistant Examiner*—John L. Beres
*Attorney, Agent, or Firm*—Dykema Gossett

[57] ABSTRACT

A pull-out lavatory is disclosed wherein a spout may be removed from a sink top to direct a stream of water to a desired location. The spout is mounted laterally offset from a lateral center of the sink top, and is firmly seated in the sink top when mounted. The spout is guided out of its seat on the sink top by rotating the spout which is moved vertically upwardly out of its mount. An arrangement prevents the spout from being rotated away from the center of the sink, since that may result in the stream of water being directed outwardly of the sink. In a further aspect of the present invention, the spout includes upper and under cover members which are snapped together and which include mating rib and notch structure to add to the stability of the spout. Also, the fluid connections within the spout housing include mounting structure that ensure they are properly aligned relative to the spout housing. The overall combination results in a pull-out lavatory that may be quickly assembled and properly aligned. Further, the inventive pull-out lavatory ensures that the spout is not inadvertently rotated in a direction such that a stream of water is directed outwardly of the sink.

23 Claims, 5 Drawing Sheets

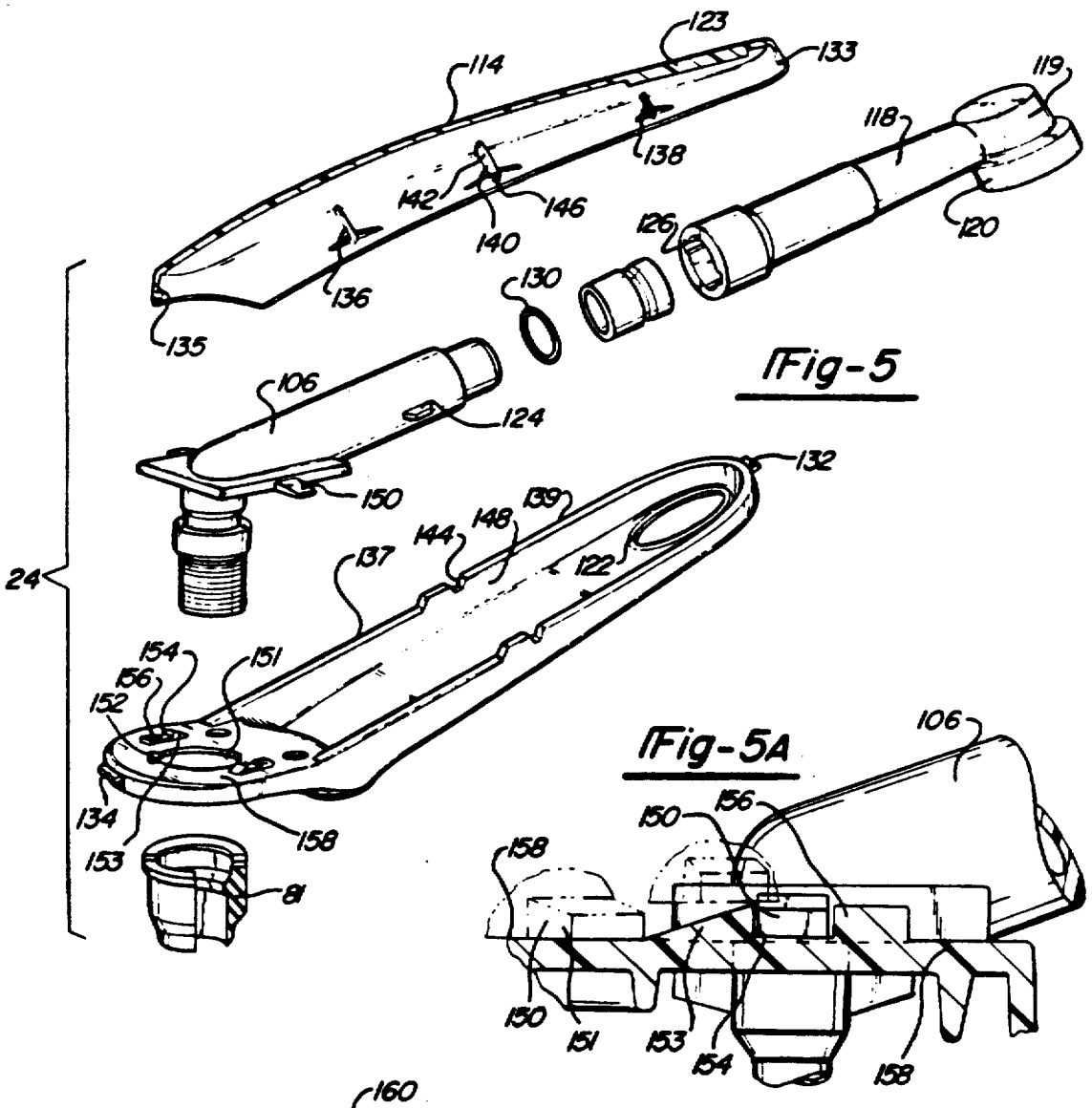
Fig-5
Fig-5A
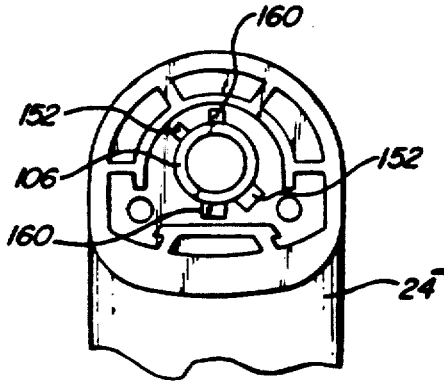
Fig-6

Fig-7
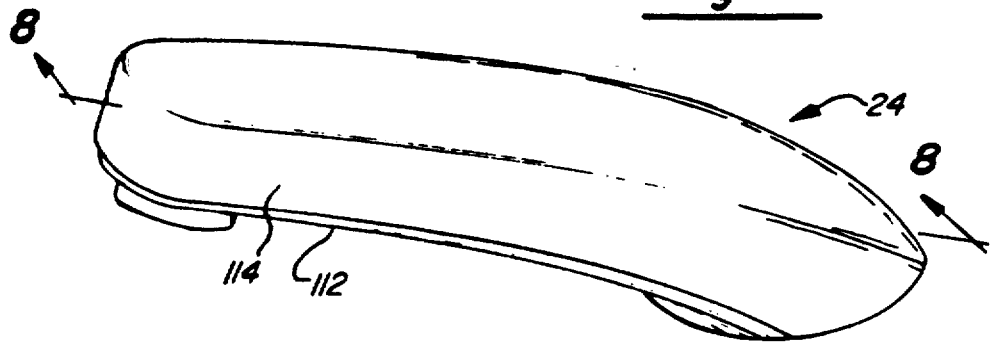
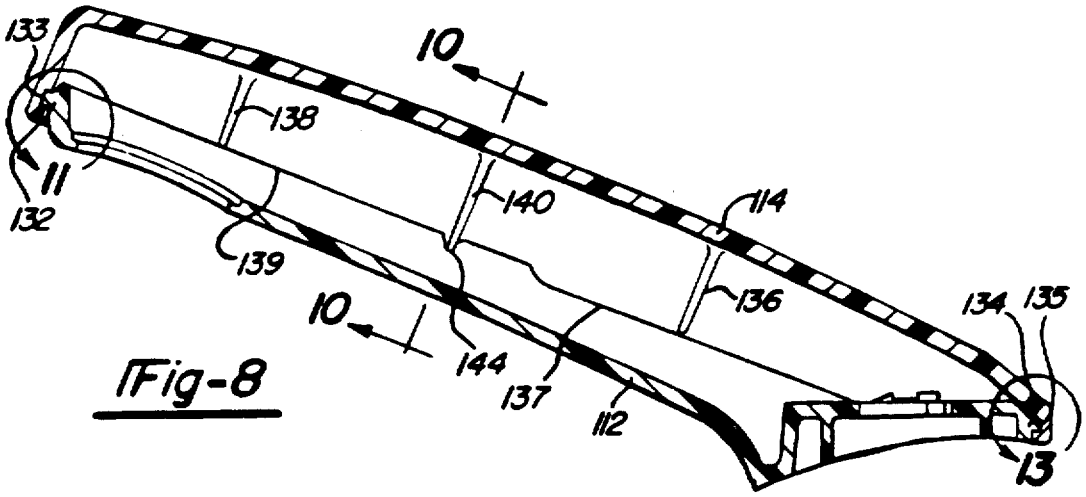
Fig-8
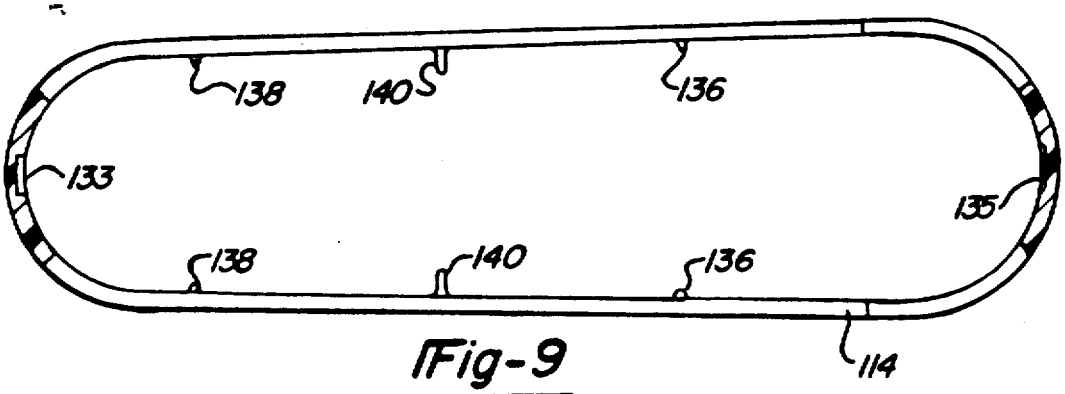
Fig-9

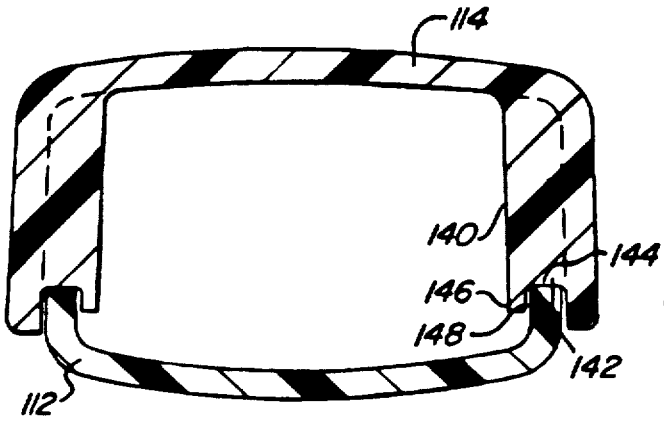
Fig-10
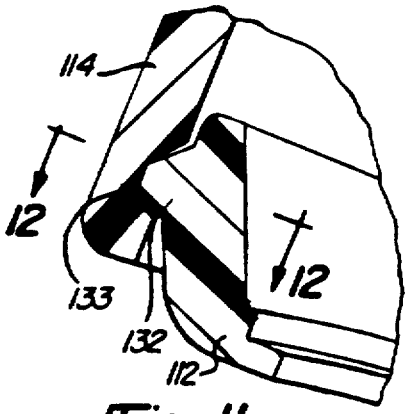
Fig-11
Fig-13
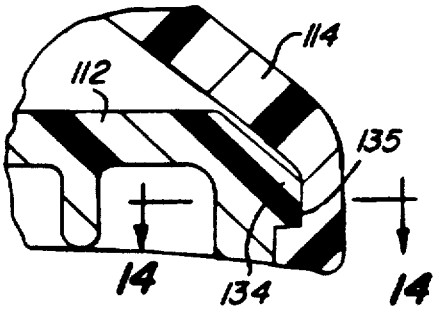
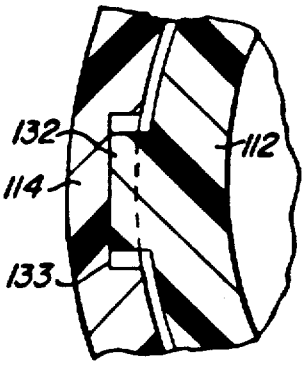
Fig-12
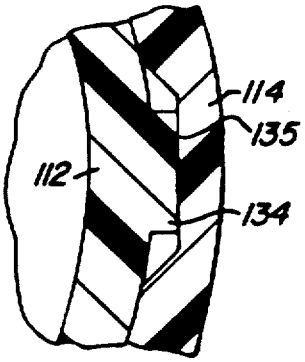
Fig-14

PULL-OUT LAVATORY

BACKGROUND OF THE INVENTION

The present invention relates to a lavatory wherein a water spout may be pulled outwardly of a sink mount to direct a stream of water as desired. More particularly, the present invention relates to such a lavatory that is easy to assemble.

Sinks of the type wherein a spout member may be removed from within a sink mount are known. Such prior art assemblies are relatively complex and thus difficult to assemble. A relatively great number of parts are required increasing assembly time. Further, it is sometimes difficult to assemble and properly align the various members.

Another problem with many prior art assemblies is that the spout may often be removed from the sink mount in a direction such that the stream of water is directed outwardly of the sink bowl, which is undesirable. As an example, a user may remove the spout in an improper direction such that a stream of water is directed onto the floor about the sink.

It is an object of the present invention to disclose a pull-out lavatory combination that has ease of assembly features which reduce the required time to assemble the lavatory, while at the same time ensuring that all members are properly aligned. Further, it is an object of the present invention to disclose such a lavatory in which the spout is prevented from being removed from the sink in an improper direction.

SUMMARY OF THE INVENTION

A disclosed pull-out lavatory includes a spout member mounted on an escutcheon such that it can be removed to direct a stream of water to a desired location. The spout is mounted at a position laterally spaced from a lateral center of the escutcheon. A gasket firmly mounts the spout within a spout shank such that the spout may direct a stream of water from a mounted position on the sink and be used as a normal faucet outlet. The spout is mounted such that it can be rotated to move the gasket out of a seat in the spout shank to make it easier to remove the spout from the sink. The spout shank has a rotation guide that prevents the spout from rotating in a direction away from the lateral center of the escutcheon. Thus, if the spout is rotated to begin removing it, it is rotated further towards the center of the escutcheon, which will typically be over the sink bowl.

In a disclosed embodiment, the shank includes a ramped top face to guide the spout and gasket upwardly out of the spout shank when rotated. Preferably, the rotation guide extends over a first arc of the shank outer circumference with a flat end at one circumferential extent and a ramped portion at the opposed end. The spout has a bottom surface which moves along the ramped top face of the spout shank, and further has a channel received over the rotation guide. The channel preferably extends over a second arc approximately equal to the first arc and has flat ends at each end. Should the spout be rotated away from the center, one channel flat end abuts the rotation guide flat end preventing rotation. On the other hand, should the spout be rotated toward the center, the other channel end is guided upwardly on the ramp, and the spout is guided out of the shank for removal and use.

Most preferably, the escutcheon is mounted on three holes which extend through a sink top. A center hole receives a lift rod actuator, one lateral hole receives a mixing valve handle for controlling the temperature of water dispensed from the spout, and the opposed lateral hole receives the spout shank and spout. The spout is constrained to rotate towards the center hole.

In another aspect of the present invention, a spout housing is formed of plastic upper and under covers which snap together to quickly assemble the spout. In a disclosed embodiment, tabs are formed at forward and rear positions of the under cover and are snapped into notches at corresponding positions on the upper cover.

Preferably, the upper cover has ribs which contact surfaces on the under cover to provide rigidity to the housing. There are preferably three ribs with a center rib extending into a notch in the under cover to align and provide rigidity to the assembled spout. Most preferably, the center rib has a finger at a laterally inner end which extends downwardly beyond the notch and abuts an inner face of the under cover. This finger provides rigidity to the assembled spout against a force compressing the spout laterally inwardly.

In another aspect of the present invention, the fluid supply line through the spout is easily assembled and properly aligned through a tab, key and notch arrangement. In a disclosed embodiment of the present invention, the under cover has members which fix an elbow connected to a water supply hose at a proper position.

In a preferred embodiment of the present invention, the elbow includes tabs received in channels formed on a planar face of the under cover to define and fix the elbow at the proper rotational position. A ramped surface is preferably formed between the channel and an initial elbow position. The elbow is rotated to move towards the proper position, and the tabs move up the ramp, eventually being guided into the channels at the proper position. Projecting tabs on the under cover define the opposed end of the channels such that the elbow cannot be rotated beyond this position.

In a most preferred embodiment, the channels hold the taps a small distance off the nominal plane of the under cover, biasing the tabs upwardly. This creates a force moment such that the remainder of the elbow is biased downwardly to ensure that it is adequately secured to the lower cover, and will not wobble.

Further, the under cover has notches extending through the nominal planar face and the elbow has keys at a lower end that are initially aligned with the notches. The keys pass through the notches to define the initial elbow position. When the elbow is rotated relative to the under cover, these keys move away from the notches and provide a locking member on an opposed face of the under cover from the tabs and channels. When the elbow is in a position such that the keys are aligned with the notches, the tabs will be positioned adjacent the ramped surface.

These and other objects and features of the present invention can be best understood from the following specification and drawings, of which the following is a brief description.

BRIEF DESCRIPTION OF THE DRAWINGS

FIG. 5 is an exploded view of the spout assembly according to the present invention.

FIG. 5A is a perspective view of a portion of the spout.

FIG. 6 is a bottom view of the spout.

FIG. 7 is a perspective view of the spout housing.

FIG. 8 is a cross-sectional view along line 8—8 as shown in FIG. 7.

FIG. 9 is a cross-sectional view through a portion of the spout housing.

FIG. 10 is a cross-sectional view along line 10—10 as shown in FIG. 8.

FIG. 11 is an enlarged view of a portion of the spout housing illustrated in FIG. 8.

FIG. 12 is a cross-sectional view along line 12—12 as shown in FIG. 11.

FIG. 13 is an enlarged view of a portion of the spout housing illustrated in FIG. 8.

FIG. 14 is a cross-sectional view along line 14—14 as shown in FIG. 13.

DETAILED DESCRIPTION OF A PREFERRED EMBODIMENT

Figure 1:
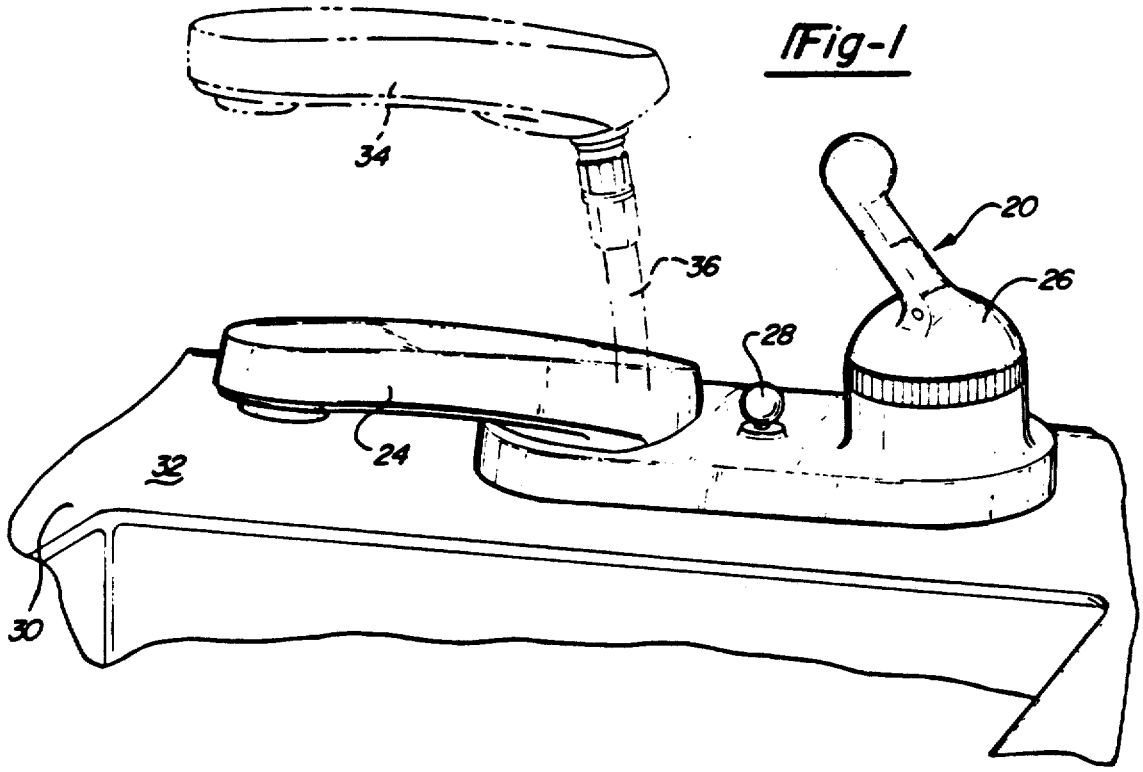
FIG. 1 is a perspective view of a pull-out lavatory according to the present invention.

Pull-out lavatory 20 is illustrated in FIG. 1 having escutcheon 22 mounting pull-out water spout 24 at one lateral end and a on/off mixing handle 26 at the opposed lateral end. Lift rod handle 28 is shown at the middle of escutcheon 22, and operates a pop-up stop plug in sink 30 as is well known. Escutcheon 22 is mounted to three holes extending through sink top 32. Pull-out spout 24 may be moved outwardly to removed position 34, with hose 36 connecting a water supply to spout 24 for directing a stream of water to a desired location.

As can be appreciated from FIG. 1, pull-out spout 24 is mounted near one lateral end of sink 30, and it would be undesirable to rotate the spout further away from the center of escutcheon 22 since its outlet could be directed outwardly of sink 30. For this reason, the disclosed spout 24 is constrained to rotate only counterclockwise and towards the center of escutcheon 22.

Figure 2:
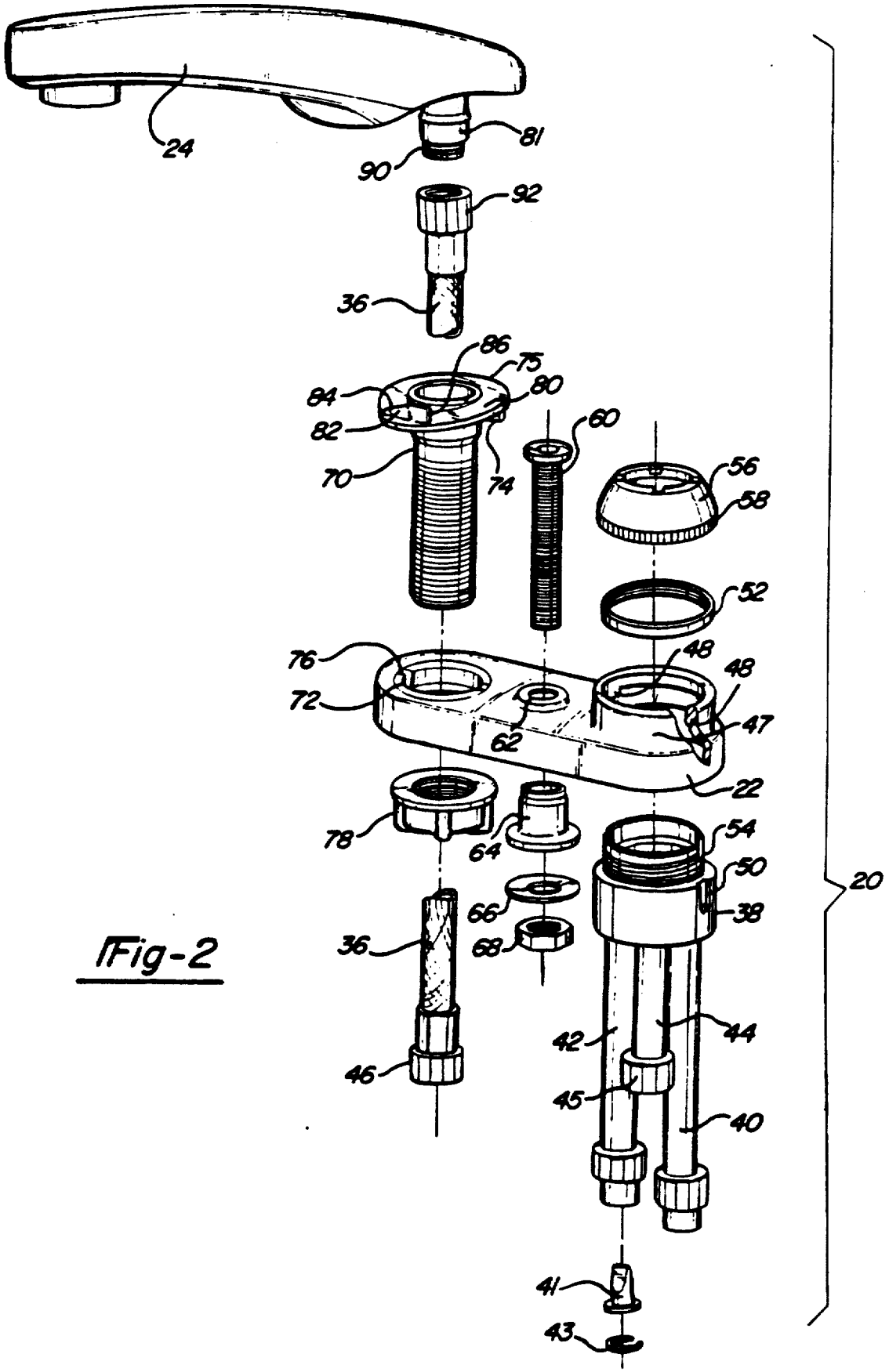
FIG. 2 is an exploded assembly view of the inventive pull-out lavatory.

FIG. 2 is an exploded assembly view of pull-out lavatory 20 which includes mixing body sub-assembly 38 brazed to a pair of lines 40 and 42 which supply hot and cold water into mixing body 38, where they are mixed in a known fashion and returned out of mixed outlet line 44. A one-way valve 41 is preferably secured by ring 43 in each line 40, 42. Mixed outlet line 44 is connected to hose 36 at threaded nipple connection 45, 46. Hose 36 has been illustrated as being relatively short, however, it should be understood that hose 36 would be of a much greater length such that spout 24 can be moved to direct a stream of water about sink 30.

Mixing body sub-assembly 38 is received within boss 47 formed on escutcheon 22. Keys 48 in boss 47 mate with notches 50 to properly align mixing body 38. Nut 52 is received on threads 54 to secure mixing body 38, and bonnet 56 is screwed down to retain the members. Bonnet 56 has skirt portion 58 received over nut 52. Mixing handle 26, FIG. 1, extends through bonnet 56 and is connected to an appropriate mechanisms within mixing body 38. This structure is well known in the art and forms no part of this invention.

Lift rod shank 60 extends through a central aperture 62 in escutcheon 22, and is secured by spacer 64 which has an internal ductile ring force-fit onto threads on shank 60. Washer 66 and nut 68 also secure shank 60. Spacer 64 ensures that shank 60 is not tightened to an overly great extent when assembled, and also allows pull-out lavatory 20 to be at least partially assembled when shipped. Lift rod 28, FIG. 1, extends through a central aperture in shank 60 and is connected to an appropriate lift mechanism as is known in the art.

Spout shank 70 is received in a third aperture 72 formed in escutcheon 22. Keys 74 at a bottom face of a radially outwardly extending lip 75 are received in notches 76 to properly position shank 70 within aperture 72. Nut 78 is received on threads at the outer periphery of spout shank 70 to secure it in aperture 72. A washer and nut combination may also be used to further secure shank 70.

Gasket 81 is connected to the bottom of spout 24 and firmly seats spout 24 in aperture 72 in a mounted position. Spout 24 may be used to direct water while in this mounted position and gasket 81 ensures that spout 24 is securely mounted to resist movement due to any force from the discharging water stream. It may be desirable to provide assistance in removing spout 24 from aperture 72 since gasket 81 seats tightly. Lip 75 has a ramped top surface 80 which guides spout 24 out of aperture 72 when rotated. Spout 24 may be rotated on top surface 80 and gasket 81 is unseated and guided at least partially out of aperture 72. As discussed above, however, it is undesirable to allow spout 24 to rotate such that it directs a water stream outwardly of the sink. In the disclosed embodiment, it would be undesirable to allow spout 24 to rotate clockwise since that would be away from the center of escutcheon 22. To this end, rotation guide 82 is formed on top surface 80, and has ramped surface 84 at one circumferential extent and flat end 86 at the opposed circumferential extent.

Figure 3:
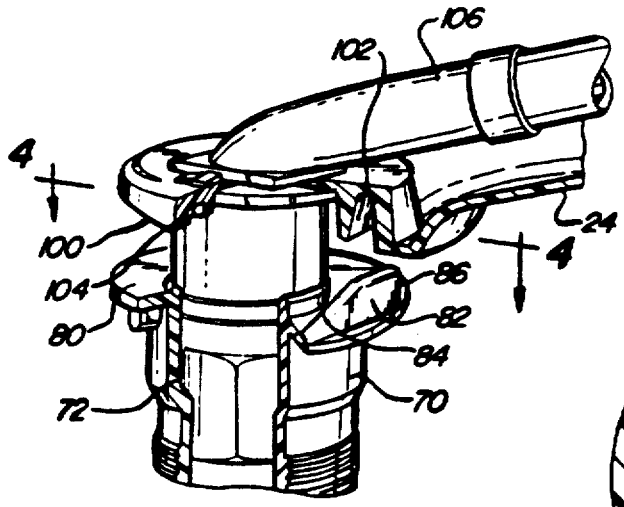
FIG. 3 is a partially broken-away perspective view of a pull-out spout mounted to a sink.

The details of the rotation of spout 24 outwardly of aperture 72 are illustrated in FIG. 3. Spout 24 has bottom 100 received on ramped top surface 80 of shank 70. As spout 24 is rotated in a counterclockwise direction, ramped top surface 80 of shank 70 guides spout 24 vertically upwardly and out of aperture 72. This assists a user in removing spout 24 from aperture 72. Channel 102 extends over a small circumferential extent of bottom 100 and has flat ends 104 at each end. Elbow 106 is mounted within spout to supply fluid from hose 36 to an outlet of spout 24.

Figure 4:
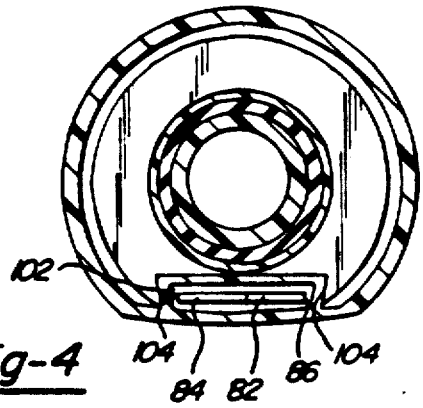
FIG. 4 is a view along line 4—4 as shown in FIG. 3.

It should be understood that spout 24 is normally received vertically downwardly from the position shown in FIG. 3, with rotation guide 82 received within channel 102. As shown in FIG. 4, rotation guide 82 extends over a circumferential arc that is approximately equal to the circumferential arc over which channel 102 extends. Ends 104 are formed at each circumferential end of channel 102, and thus one end 104 abuts flat end 86 of rotation guide 82, while the other end 104 is positioned adjacent ramp 84. Should a user attempt to rotate spout 24 in a clockwise direction end 104 abuts flat end 86 and rotation is prevented. When a user rotates spout 24 counter-clockwise, however, end 104 is guided upwardly on ramp 84 and bottom 100 is also guided upwardly on ramp surface 80. In this way, spout 24 is raised slightly out of aperture 72 unseating gasket 81 such that a user may easily remove spout 24 for use.

FIG. 5 is an exploded view of spout 24 showing elbow 106 received in under cover 112 which is snapped to an upper cover 114 to form spout 24. Elbow 106 is connected to spout outlet 118 having head 119 disposed adjacent to outlet port 120. Outlet port 120 is received in a line to line close fit with end bore 122 in undercover 112. Resilient foam gasket 123 is positioned within an inner surface of upper cover 114 and biases head 119 into bore 122. The close fit between outlet port 120 and end bore 122 ensure that outlet 118 is properly positioned within spout 24. Optional keys 124 on elbow 106 may be received within notches 126 formed on spout outlet 118 to further ensure alignment and proper rotational positioning. Check valve assembly 128 and O-ring 130 are preferably received between elbow 106 and outlet 118.

Under cover 112 is snapped to upper cover 114 through front tab 132 received in notch 133 and back tab 134 received in notch 135. Preferably, one tab is first placed in one notch and the other tab is snapped into the other notch.

Upper cover 114 has rear rib 136 resting on rear ledge 137 on under cover 112 and forward rib 138 resting on forward ledge 139 when the covers 112, 114 are snapped together. The ribs provide additional rigidity to the assembled spout 24.

Center rib 140 has outer portion 142 received in notch 144 in under cover 112. Finger 146 is formed at the inner end of center rib 140 and extends beyond notch 144, abutting inner wall 148 of under cover 112. It should be understood that upper cover 118 has symmetrical ribs 136, 138 and 140 on the opposed lateral side received on corresponding structure on under cover 112. Fingers 146 add stability, preventing inward flexing of the walls of spout 24. This is particularly desirable since under cover 112 and upper cover 114 are preferably molded from plastic and may require extra rigidity. Most preferably, the covers may be coated with chrome.

Elbow 106 has tabs 150 extending radially outwardly. A lower portion of elbow 106 extends through aperture 151 in under cover 112. Notches 152 are formed in undercover 112. Keys, described below, are formed on an under surface of elbow 106 and are initially aligned with notches 152 when elbow 106 is inserted through aperture 151. With the keys in this position, tabs 150 are positioned adjacent ramps 153, thus assuring that elbow 106 is in the proper mounting position.

Channel 154 is spaced from ramp 153 and projecting tab 156 is spaced on the opposed side of channel 154. Elbow 106 is inserted in aperture 151 and is turned counterclockwise as shown in this figure. Tabs 150 are guided upwardly on ramps 153 and snap into channels 154 to define and fix elbow 106 at the proper rotational position relative to under cover 112. Projecting tabs 156 prevent further rotation of elbow 106.

The details of the receipt of tabs 150 in channels 154 are illustrated in FIG. 5A. Tab 150 is initially received in position 151, shown in phantom, at which it lies on a nominal plane 158 of under cover 112, adjacent ramp 153. As elbow 106 is rotated, tab 150 is moved upwardly on ramp 153 and eventually snaps into channel 154. Projecting tab 156 prevents further rotation of elbow 106. As shown, channel 154 has a bottom surface that extends a small distance above nominal plane 158 of under cover 112. Channels 154 thus bend tabs 150 slightly vertically upwardly from a relaxed position on nominal plane 158, and a force moment is created biasing the center of elbow 106 downwardly against under cover 112 ensuring that it is firmly mounted. Gasket 81 is received on the opposed end of elbow 106 to further lock elbow 106 to under cover 112.

FIG. 6 is a bottom view of spout 24 and illustrates elbow 106 having keys 160. As described above, keys 160 are aligned with notches 152 and elbow 106 is inserted through aperture 151. Elbow 106 is then rotated until tabs 150 align with channels 154, see FIG. 5A. At that time, keys 160 have rotated away from notches 152 locking elbow 106 to under cover 112. Further, keys 160 are of different thicknesses to ensure a proper initial position of elbow 106.

The structure of under cover 112 and upper cover 114 will now be described in detail with references to FIGS. 7 through 14. As shown in FIG. 7, spout 24 consists of under cover 112 snapped to upper cover 114.

As shown in FIG. 8, upper cover 114 has notches 133 and 135 which receive tabs 132 and 134, respectively, from under cover 112. Ribs 136 and 138 abut ledge surfaces 137 and 139, respectively. Center rib 140 is received within notch 144.

FIG. 9 is a view looking upwardly into upper cover 114. As can be seen, upper cover 114 is symmetrical about a central axis with laterally opposed pairs of ribs 136, 138 and 140.

FIG. 10 is a cross-sectional view along line 10—10 as shown in FIG. 8. Upper cover 114 has center rib 140 with outer portion 142 received in notch 144 and finger 146 abutting inner wall 148 of under cover 112. Fingers 146 thus provide additional rigidity against laterally inward flexing of spout 24.

FIG. 11 is an enlarged portion of the section of FIG. 8 identified by numeral 11. Tab 132 in under cover 112 is received in notch 133 in upper cover 114. FIG. 12 is a cross-sectional view along line 12—12 as shown in FIG. 11. As shown, tab 132 is received in notch 133.

FIG. 13 is an enlarged view of the section of FIG. 8 identified by numeral 13. Tab 134 in under cover 112 is received in notch 135 in upper cover 114. FIG. 14 is a cross-sectional view along line 14—14 as shown in FIG. 13. As shown, tab 134 is received in notch 135.

It should be understood that although pull-out lavatory 20 has been described in detail, several other known elements are not disclosed. As an example, the details of the mixing valve within mixing body 38 are not disclosed since they are well known in the art.

A preferred embodiment of the present invention has been disclosed, however, a worker of ordinary skill in the art would recognize that certain modifications would come within the scope of this invention. For this reason, the following claims should be studied in order to determine the true scope and content of this invention.

I claim:

1. A spout comprising:

a housing having an inlet aperture and an outlet aperture;

an elbow enclosed within said housing, mounted in said inlet aperture and adapted to be connected to a source of water, and means to communicate the water to said outlet aperture;

said elbow having a tab locked into a portion of said housing, said elbow being rotatable within said inlet aperture when said tab is not locked into said portion, said tab moving along a surface of said housing and allowing said elbow to rotate within said inlet aperture until said elbow reaches a desired position, said tab being locked into said portion when said elbow reaches said desired position, preventing further rotation of said elbow in either rotational direction relative to said housing.

2. A spout as recited in claim 1, wherein said portion including said housing having at least one channel, said elbow tab being received in said channel to fix said elbow at said desired rotated position, a channel ramp being formed on said housing adjacent said channel and extending from a first end at a nominal planar face of said housing to a second end raised off of said nominal planar face, said channel being defined in-part by said second end, a flat tab formed on said housing and raised from said nominal planar face at the opposed end of said channel such that said channel defines a pocket to receive said elbow tab, said elbow being mounted to said housing by first positioning said elbow tab adjacent said first end of said ramp and rotating said elbow with said elbow tab moving up said ramp until said elbow reaches said desired rotated position at which time said elbow tab snaps into said channel, said flat tab preventing further rotation of said elbow.

3. A spout as recited in claim 2, wherein said channel maintains said elbow tab in a position flexed away from a relaxed position on said nominal planar face, such flexing creating a force moment biasing said elbow against said housing.

4. A spout as recited in claim 3, wherein there are a pair of said elbow tabs and a pair of said channel ramps, channels and flat tabs.

5. A spout as recited in claim 3, wherein said elbow has at least one key at one end, and said housing having a mating key notch adjacent said inlet aperture, said elbow and said housing being configured such that when said key is aligned with said key notch, said elbow tab is positioned adjacent said channel ramp.

6. A spout as recited in claim 1, wherein said means to communicate water to said outlet aperture include a tube connected to said elbow and received in said outlet aperture, said tube having an outlet end closely received in said outlet aperture to ensure that it is properly positioned, and biasing means on said housing biasing said outlet end into said outlet aperture to maintain said tube in a proper position.

7. A spout as recited in claim 1, wherein said housing comprises upper and under covers that are snapped together, said inlet and outlet apertures being formed in said under cover.

8. A spout comprising:

a housing having an inlet aperture and an outlet aperture;

an elbow mounted in said inlet aperture and adapted to be connected to a source of water, and means to communicate the water to said outlet aperture;

said elbow having at least one elbow tab to ensure that it is fixed in a desired rotated position relative to said housing;

said means to communicate water to said outlet aperture include a tube connected to said elbow and received in said outlet aperture, said tube having an outlet and closely received in said outlet aperture to ensure that it is properly positioned, and biasing means on said housing biasing said outlet end into said outlet aperture to maintain said tube in a proper position; and said housing comprising upper and under covers that are snapped together, said inlet and outlet apertures being formed in said under cover, and said biasing means including a resilient member in said upper cover biasing said tube into said outlet aperture.

9. A pull-out spout and sink combination comprising:

a sink having a sink top;

a spout connected to a supply of water for selectively delivering a stream of water, said spout being mounted to said sink top such that it may be removed from said sink top to direct the stream of water to a desired location, said spout being mounted laterally offset from a lateral center of said sink and said spout having a stop face received adjacent a stop face on said sink top, said spout being free to rotate relative to said sink in a direction towards said lateral center, but being prevented from rotating in a direction away from said lateral center by said spout stop face being forced into said sink top stop face.

10. A combination as recited in claim 9, wherein said spout is mounted in an escutcheon fixed to said sink top, said sink top having three holes with a center hole aligned with said lateral center, a second hole spaced laterally from said lateral center, and a third hole laterally spaced from said center on an opposed side of said center from said second hole, said spout being mounted in said third hole.

11. A combination as recited in claim 9, wherein rotation of said spout towards said center assists in moving said spout out of said sink top, said spout having a channel with two flat ends, one being said stop face, and received on a rotation guide associated with said sink top, said channel flat ends being spaced by a first arc, said rotation guide extending for a second arc approximately equal to said first arc and said sink top stop face being a rotation guide flat end at one end of said second arc and a rotation ramp at the other end of said second arc, a first of said channel flat ends being forced against said rotation guide flat end preventing rotation should said spout be rotated away from said lateral center, and a second of said channel flat ends being guided up said rotation ramp should said spout be rotated towards said center.

12. A pull-out spout and sink combination comprising:

a sink having a sink top;

a spout connected to a supply of water for selectively delivering a stream of water, said spout being mounted to said sink top such that it may be removed from said sink top to direct the stream of water to a desired location, said spout being mounted laterally offset from a lateral center of said sink and said spout being free to rotate relative to said sink in a direction towards said lateral center, but being prevented from rotating in a direction away from said lateral center;

said spout being mounted in an escutcheon fixed to said sink top, said sink top having three holes with a center hole aligned with said lateral center, a second hole spaced laterally from said lateral center, and a third hole laterally spaced from said center on an opposed side of said center from said second hole, said spout being mounted in said third hole; and a shank being fixed in said third hole and having a ramped surface that supports said spout when it is mounted within said third hole, said ramped surface moving said spout outwardly of said third hole when it is rotated towards said lateral center to allow said spout to be easily removed from said third hole.

13. A combination as recited in claim 11, wherein a rotation guide extends away from said ramped surface, said rotation guide being received in a spout channel formed in said spout, said spout channel having flat ends spaced by a first arc, said rotation guide extending for a second arc approximately equal to said first arc and having a flat end at one end and a rotation ramp at the other end, a first of said channel flat ends being forced against said rotation guide flat end preventing rotation should said spout be rotated away from said lateral center, and a second of said channel flat ends being guided up said rotation ramp should said spout be rotated towards said lateral center.

14. A combination as recited in claim 12, wherein a gasket firmly seats said spout in a mounted position in said shank, and rotation towards said center unseats said spout.

15. A spout comprising:

a housing formed of an upper cover and an under cover, said under cover having an inlet aperture and an outlet aperture, said inlet aperture being adapted to be connected to a water supply, and means to communicate fluid from said inlet aperture to said outlet aperture;

one of said upper and under covers having at least one tab and the other having at least one notch, said tab being snapped into said notch to secure said upper and under covers to each other, and form said housing; and said upper housing having a plurality of ribs at each lateral side thereof, said ribs being supported on said under cover at positions between said forward and rearward tabs to add stability to said housing.

16. A spout as recited in claim 15, wherein said upper and under covers have a forward tab and notch adjacent said outlet aperture, and a rearward tab and notch adjacent said inlet aperture.

17. A spout as recited in claim 15, wherein said upper housing having three of said ribs at each lateral side of said upper cover, a center rib being received in a notch in said under cover.

18. A spout as recited in claim 17, wherein said center rib extending towards said under cover for a first distance at a position closer to an inner face of said upper cover, and extending to a second distance greater than said first distance at an inner position more removed from said upper cover to form an inner finger that abuts an inner wall of said under cover, providing additional stability against a force directed laterally inwardly to said housing.

19. A spout comprising:

a housing formed of an upper cover and a under cover, said under cover having an inlet aperture and an outlet aperture, said inlet aperture being adapted to be connected to a water supply, and means to communicate fluid from said inlet aperture to said outlet aperture;

one of said upper and under covers having at least one tab and the other having at least one notch, said tab being snapped into said notch to secure said upper and under covers to each other, and form said housing; and said upper cover having center rib received in a notch in said under cover, said center rib extending towards said under cover for a first distance at a position closer to an inner face of said upper cover, and extending to a second distance greater than said first distance at an inner position more removed from said upper cover to form an inner finger that abuts an inner wall of said under cover, providing additional stability against a force directed laterally inwardly to said housing.

20. A method of assembling a spout comprising the steps of:

initially positioning an elbow within a first housing part by aligning a key on the elbow with a notch within the first housing part;

pushing the key through the notch;

rotating the elbow until the elbow reaches a fixed desired rotated position and snaps into a locked position with respective to the first housing part; and attaching a second housing part to the first housing part such that the elbow is received between the two.

21. A pull-out spout and sink combination comprising:

a sink having a sink top with an escutcheon mounted on said sink top, said sink top having three holes with a center hole on a lateral center on said sink, said center hole receiving a handle to control a drain from said sink, a second hole spaced laterally from said center hole receiving a temperature mixing handle, and a third hold spaced laterally on opposed side of said center from said second hole;

a spout connected to a supply of water for selectively delivering a stream of water, said spout being mounted to said sink and received within said third hole such that it may be removed from said third hole;

said spout having a channel with flat ends that are received on a rotation guide associated with said sink top, said channel ends spaced by a first arc, said rotation guide extending for a second arc approximately equal to said first arc and having a rotation guide flat end at one end and a rotation ramp at the other end, a first of said channel flat ends being forced against said rotation guide flat end preventing rotation should said spout be rotated away from said center hole, and a second of said channel flat ends being guided up said rotation ramp should said spout be rotated towards said center hole;

said spout including a housing having an inlet aperture and an outlet aperture, with an elbow mounted in said inlet aperture and connected to said supply of water, and means to communicate the water to said outlet aperture, said elbow having an elbow tab to ensure that it is received in a fixed desired rotated position relative to said housing; and a housing formed of an upper cover and an under cover, said under cover having said inlet aperture and said outlet aperture, one of said upper and under covers having at least one tab and the other having at least one notch, said tab being snapped into said notch to secure said upper and under covers to each other and form said housing.

22. A spout as recited in claim 21, wherein said housing having at least one channel, and said elbow tab on said elbow being received in said channel to fix said elbow at said desired rotated position, a channel ramp being formed on said housing adjacent said channel and extending from a first end at a nominal planar face of said housing to a second end raised off of said nominal planar face, said channel being defined in-part by said second end, a flat tab formed on said housing and raised from said nominal planar face at the opposed end of said channel such that said channel defines a pocket to receive said elbow tab, said elbow being mounted to said housing by first positioning said elbow tab adjacent said first end of said channel ramp and rotating said elbow with said elbow tab moving up to said channel ramp until said elbow reaches said desired rotated position, at which time said elbow tab snaps into said elbow channel, said elbow tab preventing further rotation of said elbow.

23. A spout as recited in claim 21, wherein said upper housing having a plurality of ribs at each opposed lateral side thereof, said ribs being supported on said under cover at positions between said inlet aperture and said outlet aperture to add stability to said housing.

* * * * *

UNITED STATES PATENT AND TRADEMARK OFFICE

CERTIFICATE OF CORRECTION

PATENT NO. : 5,073,991

DATED : 12/24/91

INVENTOR(S) : G. Marty

It is certified that error appears in the above-identified patent and that said Letters Patent is hereby corrected as shown below:

Title Page:

Assignee: "501 Masco Industries, Inc.", change to --Masco Corporation of Indiana--

Signed and Sealed this

Thirteenth Day of April, 1993

*Attest:*

STEPHEN G. KUNIN

*Attesting Officer*

*Acting Commissioner of Patents and Trademarks*